US005230558A

United States Patent [19]

Jong

[11] Patent Number: 5,230,558

[45] Date of Patent: Jul. 27, 1993

[54] HEADLIGHT

[76] Inventor: Chion B. Jong, P.O. Box 82-144, Taipei, Taiwan

[21] Appl. No.: 950,027

[22] Filed: Sep. 24, 1992

[51] Int. Cl.[5] ..... F24L 15/14

[52] U.S. Cl. ..... 362/105; 362/184

[58] Field of Search ..... 362/184, 196, 199, 203, 362/105

[56] References Cited

U.S. PATENT DOCUMENTS 4,616,297 10/1976 Liu ..... 362/184

*Primary Examiner*—Carroll B. Dority

*Attorney, Agent, or Firm*—Alfred Lei

[57] ABSTRACT

This invention relates to a headlight and in particular to one including a cross bar having a nose tab at an intermediate portion and a light seat at both ends thereof, a skull temple being formed with a battery chamber in which are mounted a connector so that the batteries therein are connected in series, a bulb fitted in the light seat and electrically connected with a first conducting member and a second conducting member, a reflective hood fitted in the light seat and enclosing the bulb, and a cylindrical member mounted on a front side of light seat, whereby the bulb will give light when the skull temple is turned open but will distinguish when the skull temple is folded.

1 Claim, 5 Drawing Sheets

HEADLIGHT

BACKGROUND OF THE INVENTION

It is found that the conventional flashlight must be held by one hand of an user thereby making the user impossible to have two hands for working at the same time. Hence, there is developed a headlight in order to eliminate drawback. However, such headlight is complicated in construction thus increasing its cost and therefore, rendering it difficult to be widely used.

Therefore, it is an object of the present invention to provide a headlight which may obviate and mitigate the above-mentioned drawbacks.

SUMMARY OF THE INVENTION

This invention relates to an improved headlight.

It is the primary object of the present invention to provide a headlight which will give light when opened and turn off when folded.

It is another object of the present invention to provide a headlight which is simple in construction.

It is still another object of the present invention to provide a headlight which is easy to operate.

It is still another object of the present invention to provided a headlight which is economic to fabricate.

It is a further object of the present invention to provide a headlight which is of industrial value.

Other objects and merits and a fuller understanding of the present invention will be obtained by those having ordinary skill in the art when the following detailed description of the preferred embodiment is read in conjunction with the accompanying drawings wherein like numerals refer to like or similar parts.

DETAILED DESCRIPTION OF THE PREFERRED EMBODIMENT

Figure 1:
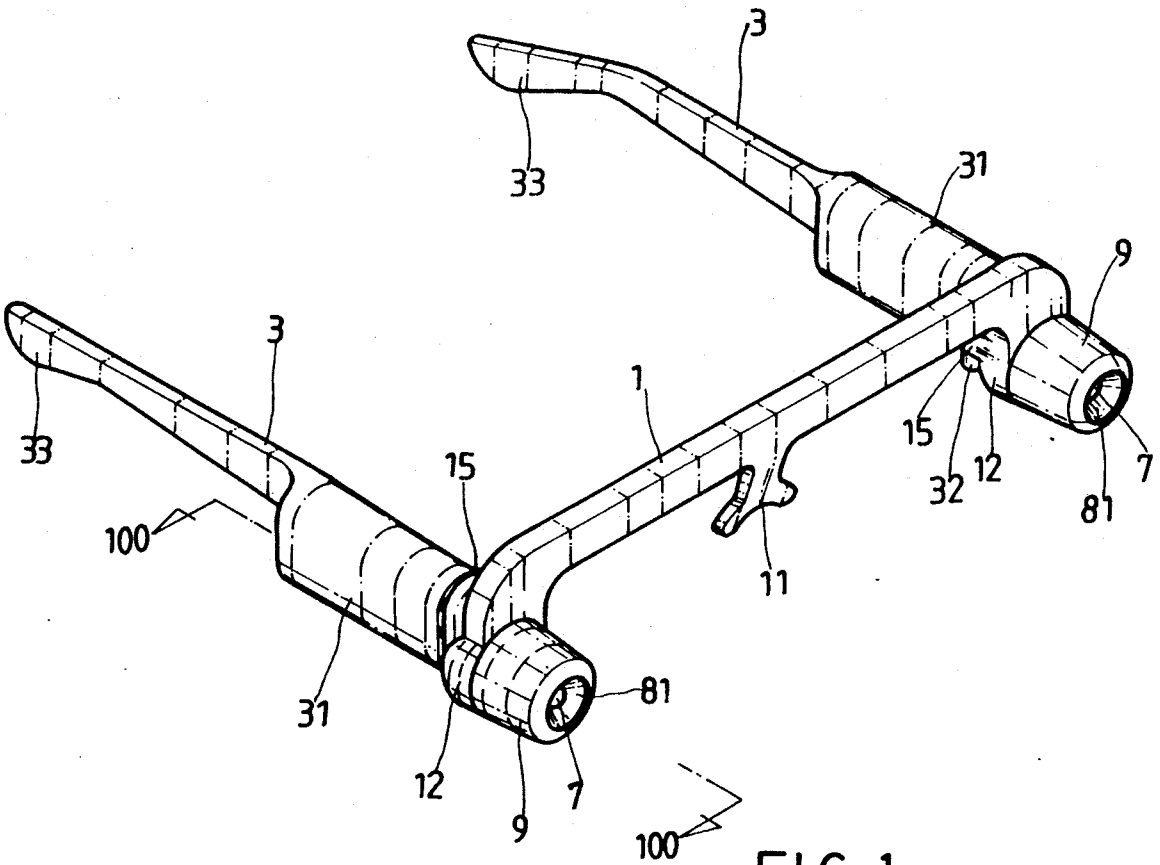
FIG. 1 is a perspective view of the present invention.

For purpose to promoting an understanding of the principles of the invention, reference will now be made to the embodiment illustrated in the drawings. Specific language will be used to describe same. It will, nevertheless, be understood that no limitation of the scope of the invention is thereby intended, such alternations and further modifications in the illustrated device, and such further applications of the principles of the invention as illustrated herein being contemplated as would normally occur to one skilled in the art to which the invention relates.

With reference to the drawings and in particular to FIG. 1 thereof, the head light according to the present invention mainly comprises a cross bar 1, a light seat 12 at both ends of the cross bar 1, and a pair of skull temples 3.

Figure 2:
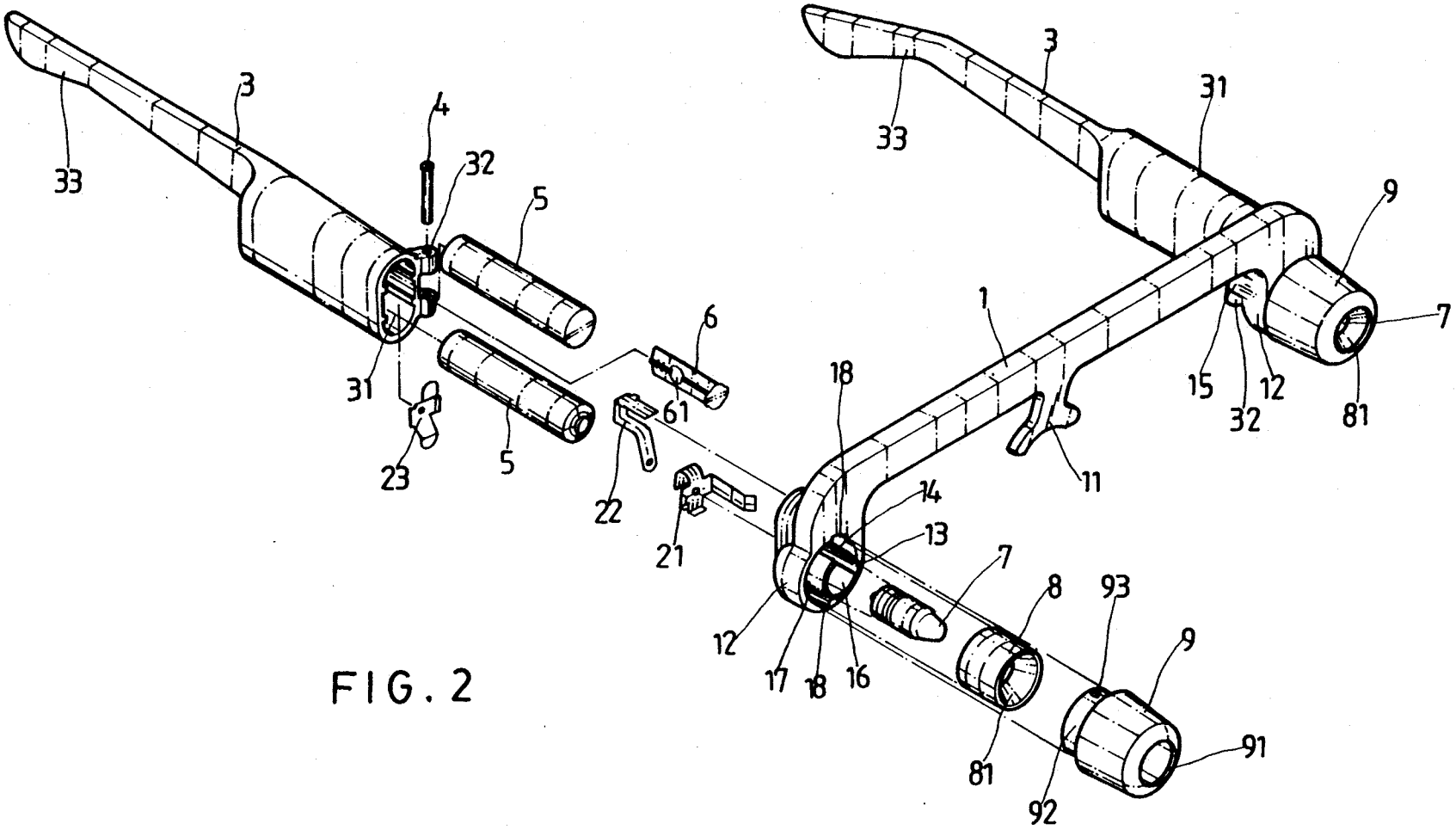
FIG. 2 is an exploded view of the present invention.
Figure 3:
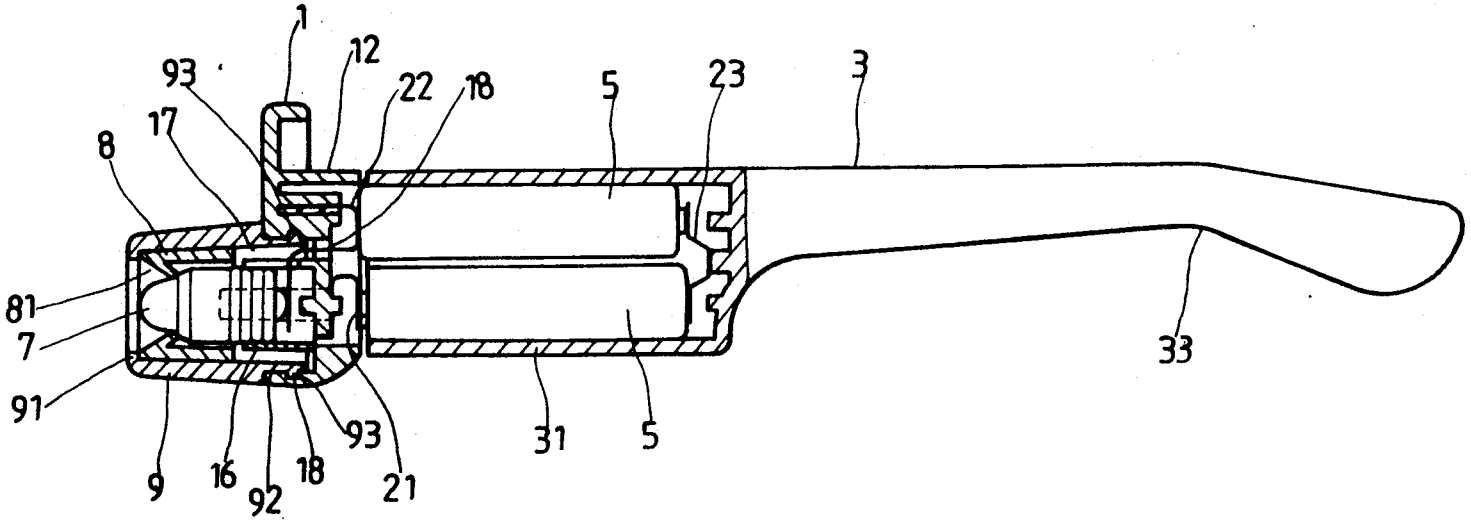
FIG. 3 is a sectional view of the present invention.
Figure 4:
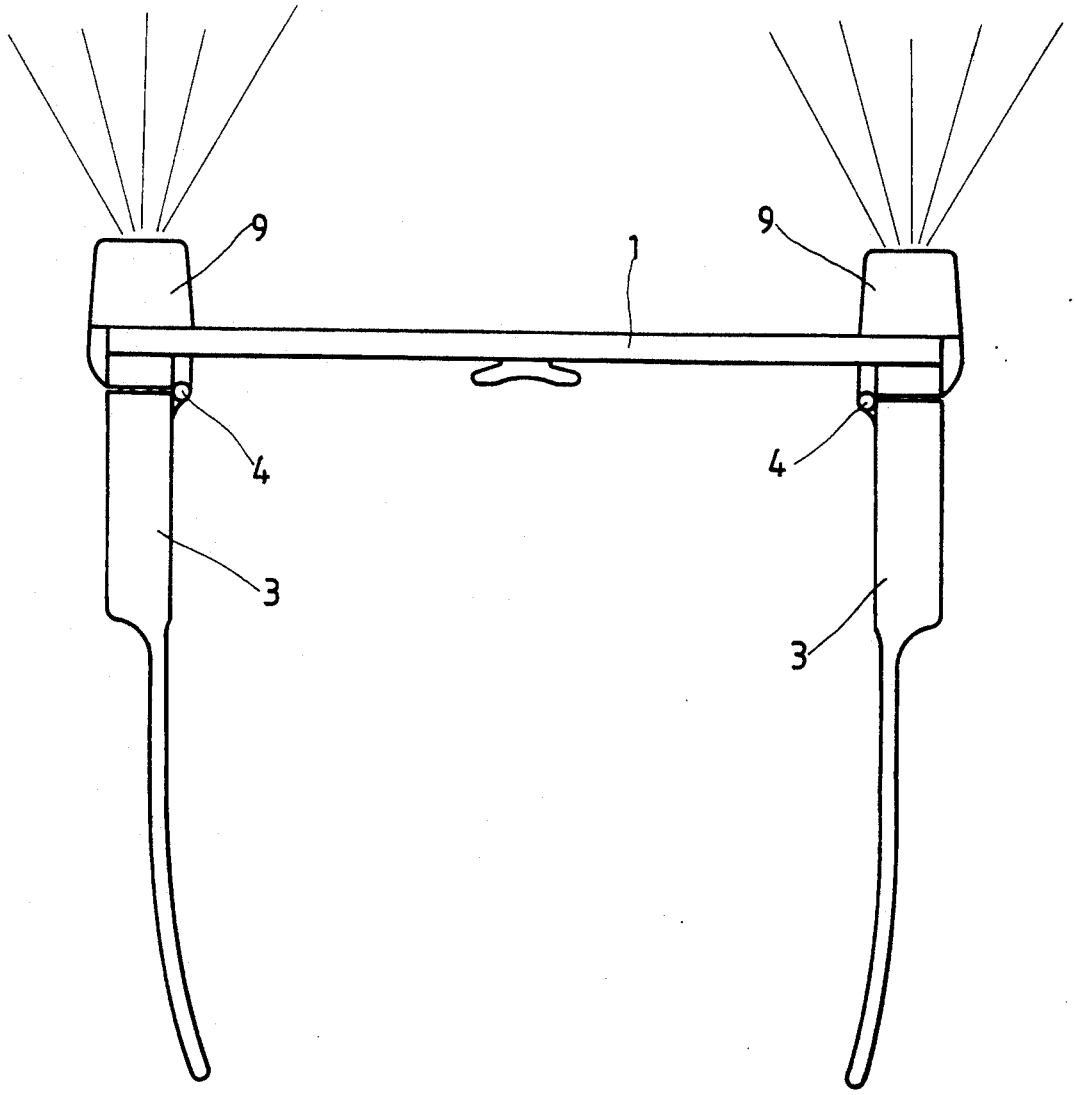
FIG. 4 is a top view of the present invention.
Figure 5:
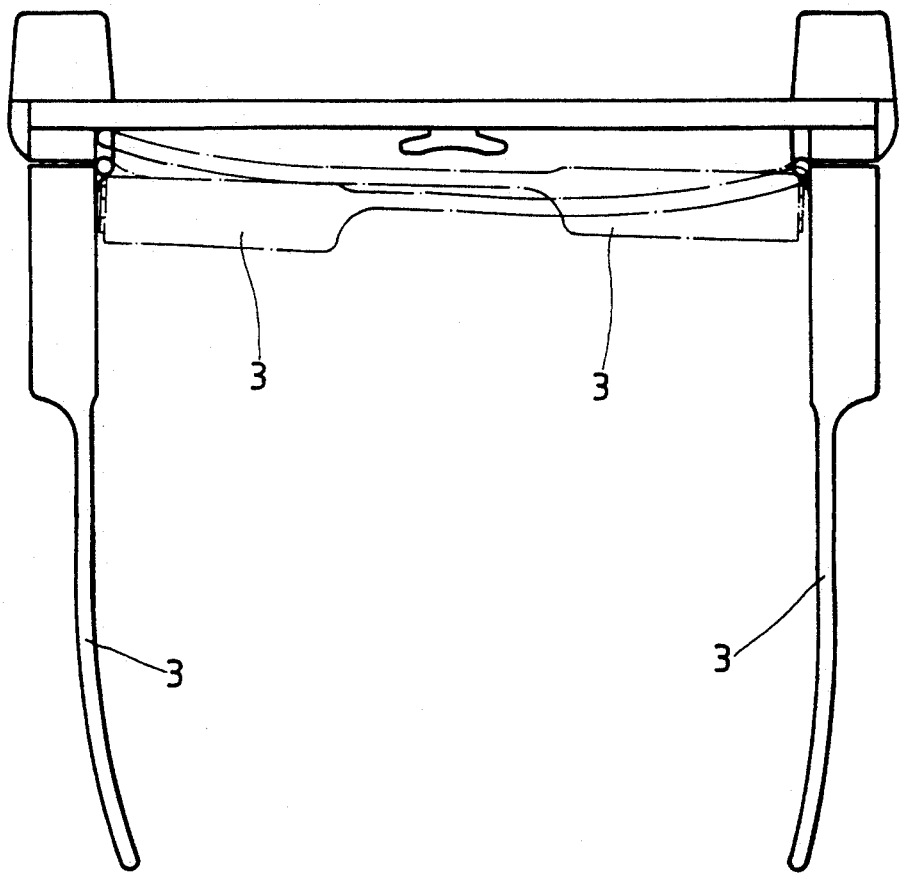
FIG. 5 shows the way to fold the present invention.

As illustrated in FIG. 2, the cross bar 1 is provided with a nose tab 11. Both ends of the cross bar 1 are provided with a light seat 12 in which there are two grooves 13 and 14 engaged with a first conducting member 21 and a second conducting member 22. A tubular member 15 (only a portion of the tubular member 15 is shown) is formed the rear side of the light seat 12 so that the cross bar 1 may be rotatably connected with the skull temple 3 by a pin inserted through the tubular member 15 of the light seat 12 and a tubular member 32 of the temple 3. The light seat 12 has a recess 16 at its front side for receiving a bulb 7 and an annular groove 17 formed with two slots 18 adapted to engage with the protuberances 93 of a cylindrical member 9.

The skull temple 3 is formed with a battery chamber 31 in which are mounted a connector 23 so that two batteries 5 therein are connected in series. Further, the batteries 5 will be in contact with the first conducting member 21 and second conducting member 22 when the skull temple 3 is turned open with respect to the cross bar 1, but will disconnected with the first conducting member 21 and second conducting member 22 when the skull temple 3 is folded. A positioner 6 is fitted into the two batteries 5 for confining the position of the batteries 5. The positioner 6 is provided with a protrusion 61 for further keeping the batteries 5 in place. In addition, the skull temple 3 is formed with a curved end piece 33 adapted to the ear of an user. A reflective hood 8 with a conical surface 81 is disposed between the cylindrical member 9 and the bulb 7.

The cylindrical member 9 is a tubular member with a frontal flange 91 for keeping the reflective hood 8 in place and a neck 92 on which there are two protuberances 93 adapted to engage with the slots 18 of the light seat 12.

When in use, simply unfold the skull temples 3 of the headlight and rest the skull temples 3 on the ears and the nose tab 11 on the nose. As the skull temples 3 are unfolded, the two batteries 5 will be in contact with the first and second conducting members 21 and 22 thereby causing the bulb 7 to give light. When the skull temples 3 are folded, the two batteries 5 will be disconnected with the conducting members 21 and 22 thus turning off the bulb 7.

Although the present invention has been described with a certain degree of particularity, it is understood that the present disclosure is made by way of example only and that numerous changes in the detail of construction and the combination and arrangement of parts may be resorted to without departing from the spirit and scope of the invention as hereinafter claimed.

I claim:

1. A headlight comprising:

a cross bar having a nose tab at an intermediate portion and a light seat at both ends thereof, said light seat being provided with a first conducting member and a second conducting member;

a skull temple being formed with a battery chamber in which are mounted a connector so that batteries therein are connected in series, said skull temple being pivotally connected with a rear side of said light seat in such a way that said batteries will be connected with said first conducting member and second conducting member when said skull temple is turned open with respect to said cross bar but will be disconnected with said first conducting member and second conducting when said skull temple is folded;

a bulb fitted in said light seat and electrically connected with said first conducting member and said second conducting member;

a reflective hood fitted in said light seat and enclosing said bulb; and a cylindrical member mounted on a front side of said light seat.

* * * * *